United States Patent [19]

Leonard

[11] Patent Number: 4,620,766

[45] Date of Patent: Nov. 4, 1986

[54] TERMINAL WITH IMPROVED RETENTION MEANS

[75] Inventor: Russell J. Leonard, Downers Grove, Ill.

[73] Assignee: Molex Incorporated, Lisle, Ill.

[21] Appl. No.: 718,413

[22] Filed: Apr. 1, 1985

[51] Int. Cl.[4] ..... H01R 13/432

[52] U.S. Cl. ..... 339/217 S

[58] Field of Search ..... 339/217 S

[56] References Cited

U.S. PATENT DOCUMENTS

| | | | |
|---|---|---|---|
| 3,701,967 | 10/1972 | Kreutter | 339/217 S |
| 3,706,954 | 12/1972 | Krafthefer | 339/17 L |
| 3,786,402 | 1/1974 | Horecky | 339/217 S |
| 3,810,072 | 5/1974 | Moore | 339/217 S |

*Primary Examiner*—Gil Weidenfeld
*Assistant Examiner*—Gary F. Paumen
*Attorney, Agent, or Firm*—Louis A. Hecht

[57] ABSTRACT

An electrical terminal having improved retention in a connector housing is disclosed. The terminal is slidingly received in a housing cavity through a rearward end of the housing. When fully inserted in the cavity, the terminal engages a stop wall adjacent the mating end of the housing. A canted locking lance extends at a given angle from the terminal body. The lance cooperates with a window formed in the housing wall when the terminal is fully inserted in the housing cavity. When the terminal is fully inserted, the housing edge adjacent the window is engaged by the lance to prevent withdrawal of the terminal from the housing cavity. First and second lance portions are defined by a branch or fork in the free end of the lance, with the first lance portion extending at a steeper angle than the second lance portion. The corner formed at the housing wall adjacent the window is thereby received between the two lance portions to prevent withdrawal of the terminal from the housing cavity.

4 Claims, 4 Drawing Figures

TERMINAL WITH IMPROVED RETENTION MEANS

BACKGROUND OF THE INVENTION

1. Field of the Invention

This invention pertains to electrical terminals employed in connector assemblies, and in particular to electrical terminals which are loaded in the rearward end of a housing, and have locking lance retention means to prevent removal of the terminals once installed in the housing.

2. Description of the Prior Art

The present invention is an improvement over electrical terminals having struck out locking lances which engage the housing in which the terminal is mounted. An example of this arrangement is given in U.S. Pat. No. 3,706,954 assigned to the assignee of the present invention. The terminal therein has a canted locking lance which is struck out at a given angle to extend in a rearward direction. The terminal is slidingly mounted in a cavity of a dielectric housing, through a rearward end of the housing. A top wall of the housing has a window formed therein communicating with the terminal receiving cavity. When the terminal is fully inserted in the cavity, the locking lance engages a window edge which is received between the lance and the terminal body, to prevent withdrawal of the terminal from the housing cavity. The lance, which is struck out from the terminal body is sufficiently resilient to be collapsibly deflected by the housing wall during initial stages of terminal insertion, and thereafter to resume its outward deflection upon entering the housing window. An interior corner or edge of the housing adjacent the window is trapped between the terminal body and the free end of the lance.

With increasing miniaturization of electrical components, electrical terminals have not only been reduced in size, but also the thickness or gauge of the metal stock from which they are formed is also being reduced. As a result, under certain circumstances, the locking lance construction has resulted in certain undesireable effects. For example, increasing miniaturization has required a reduction in the housing wall thickness in which the lance-receiving window is formed. During attempted withdrawal of the terminal from the connector housing, the locking lance has been observed to project beyond the top surface of the housing wall. Thus, when completed conductor assemblies are placed back to back, with adjacent aligned window portions, the risk of shorting the circuits of one connector to those of the adjacent connector is present.

With the corresponding reduced wall thickness in the connector housing, damage to the window edge during loading of the terminal and spring back of the lance, a rounding deformation of the edge has been observed. Thus, the free end of the lance can more easily cam across the deformed edge allowing easier withdrawal of the terminal from the housing cavity.

SUMMARY OF THE INVENTION

It is therefore an object of the present invention to provide an improved terminal retention for an electric terminal mounted in a dielectric housing.

Another object of the present invention is to provide a terminal having an additional housing engaging member, which is simply and economically formed from existing electrical terminal designs.

These and other objects of the present invention are accomplished in an electrical terminal for mounting in a dielectric housing, said housing including a terminal receiving cavity having a longitudinally extending wall having a window formed therein with an edge, an interior corner formed between the longitudinally extending cavity wall and the rear window edge, said terminal including a body having a rearwardly canted locking lance and extending at a given angle therefrom, said lance adapted to cooperate with said window when the terminal is fully inserted in said cavity to prevent withdrawal of said terminal from said housing cavity, the improvement in said terminal comprising:

said lance including first and second lance portions extending at different angles relative to said terminal body, whereby said interior corner is adapted to be received between said two lance portions, said first lance portion engaging said rear window edge and said second lance portion engaging said longitudinally extending cavity wall to prevent withdrawal of said terminal from said housing cavity.

BRIEF DESCRIPTION OF THE DRAWINGS

In the drawing, wherein like elements are referenced alike.

DETAILED DESCRIPTION OF THE PREFERRED EMBODIMENT

Figure 1:
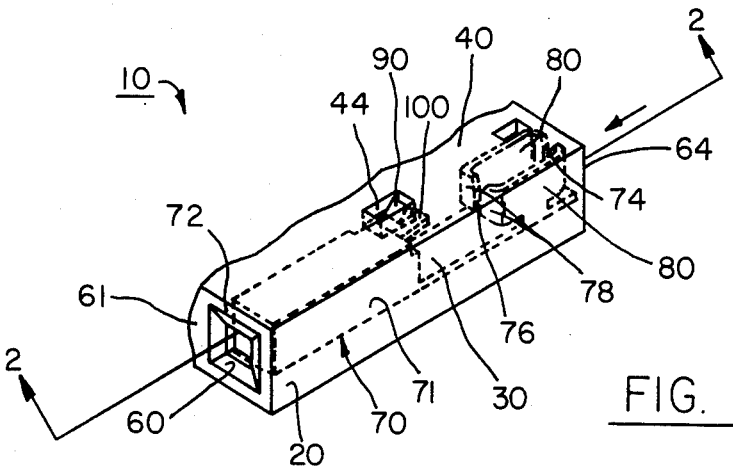
FIG. 1 is a perspective view of a terminal according to the present invention shown mounted in a connector housing.
Figure 2:
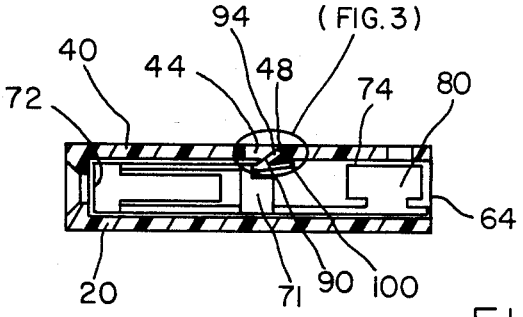
FIG. 2 is a cross section view taken along the lines 2—2 of FIG. 1.

Referring now to the drawings, and particularly to FIG. 1, a connector assembly 10 is shown comprising a dielectric housing 20 having a terminal receiving cavity 30 formed therein. An upper housing wall 40 has a lance-receiving window 44 formed therein. As can be seen most clearly in the cross section view of FIG. 2, window 44 defines an interior corner 46 formed between a contiguous window edge surface 48 and an interior housing surface 50 which faces cavity 30. Window edge surface 48 extends between interior cavity surface 50 and an external surface 52 of housing top wall 40. Housing 20 has a forward mating end 60 and a rearward terminal loading end 64.

A terminal 70 is received in cavity 30, being slidingly inserted through an opening 64 of the rearward housing end. Terminal 70 includes a forward mating end 72 and rearward conductor engaging end 74. A conventional insulation displacing slot 76 is formed between the adjacent knife-like edges 78 of formed wire engaging walls 80. The forward mating end 72 is shown as a pin-receiving member although, for the purpose of the present invention, it could comprise a pin-like member, a blade-like member or other suitable terminal engaging portion.

Figure 3:
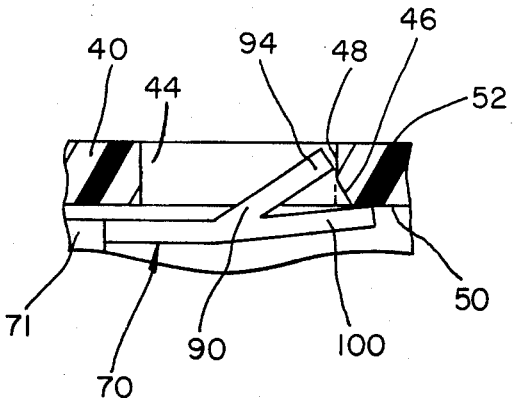
FIG. 3 is a partial view of FIG. 2 shown in greater detail.

The leading end 72 of terminal 70 is inserted through the rear opening 64 of housing 20 into cavity 30 until its forward motion is stopped when terminal leading end 72 contacts the restricted forward end wall 61 of housing mating end 60. To maintain terminal 70 captive within housing 20, a canted locking lance 90 extends from the body of terminal 70 at a given angle therefrom. As can be seen most clearly in FIGS. 2 and 3, lance 90 opens or extends in a rearward direction, toward the rear end wall portion of housing 20. Lance 90 has a free end that branches or forks to define an upper leg or lance portion 94 that is received in window 44 and engages window edge surface 48 when terminal 70 is fully inserted in cavity 30. A lower leg or lance portion 100 extends at a shallower angle than the first lance portion 94. As shown in the enlarged cross section of FIG. 3, corner 46 is received in the fork-like area between the two legs or lance portions 94, 100 to prevent withdrawal of terminal 70 from housing cavity 30.

As will be appreciated by those skilled in the art, the terminal retention arrangement of the present invention constitutes an improvement over a single locking lance. As terminal 70 is slidingly inserted in housing cavity 30, lance 90 (having a predetermined amount of resilience), is downwardly deflected upon engaging inner housing surface 50, with upper leg or lance portion 94 frictionally engaging inner surface 50 until, upon entering window 44, it is free to resume its original outward deflection. It is possible, owing to the relative geometry of terminal 70, top wall 40, and the material compositions thereof, that upon entering window 44, the upper leg portion 94 of lance 90 might tend to "round-off" or otherwise deteriorate the corner 46 of top housing wall 40. With a portion of window edge surface 48 and corner 46 thus deteriorated, a rounded camming surface is presented to upper leg portion 94, thus reducing the terminal's retention force. With the present invention, second lance portion 100 also engages inner housing surface 50 to augment the retention force of the terminal.

With the increasing trend toward miniaturization, the overall size of housing 20 and terminal 70 is reduced, and the thickness of those members is also diminished. Dificulties with conventional designs have been experienced with terminal material thicknesses less than 0.015 inches, or lance-retaining housing wall thicknesses less than 0.015 inches. Recently, top wall 40 is made very thin, and accordingly window edge surface 48 is greatly reduced in length. As a result of the terminal being made from a thinner material, a different failure mode has recently been exhibited by conventional locking lances. When a terminal is subjected to failure from high pull out forces, the locking lance is deflected to a greater angle from the terminal body, and, owing to the thinner housing wall construction, is able to penetrate beyond the outer surface of the housing, thus presenting the possibility of making contact with an adjacent circuit member. In particular, if such connectors are paired side by side, the circuits of one connector could possibly contact the circuits of an adjacent connector during terminal pullout.

These difficulties are overcome with the present invention wherein the use of a second locking lance portion 100 reduces the risk of shorting since second locking lance portion 100 prevents lateral displacement of terminal body portion 71 toward interior housing surface 50 and movement of lance portion 94 beyond the housing wall.

Also, the double locking lance construction of the present invention provides a more secure engagement with the window edge and corner 46 because resilient engagement of lance portion 100 against housing wall 50 prevents camming and downward deflection of lance 90 during application of a pullout force to terminal 70.

Figure 4:
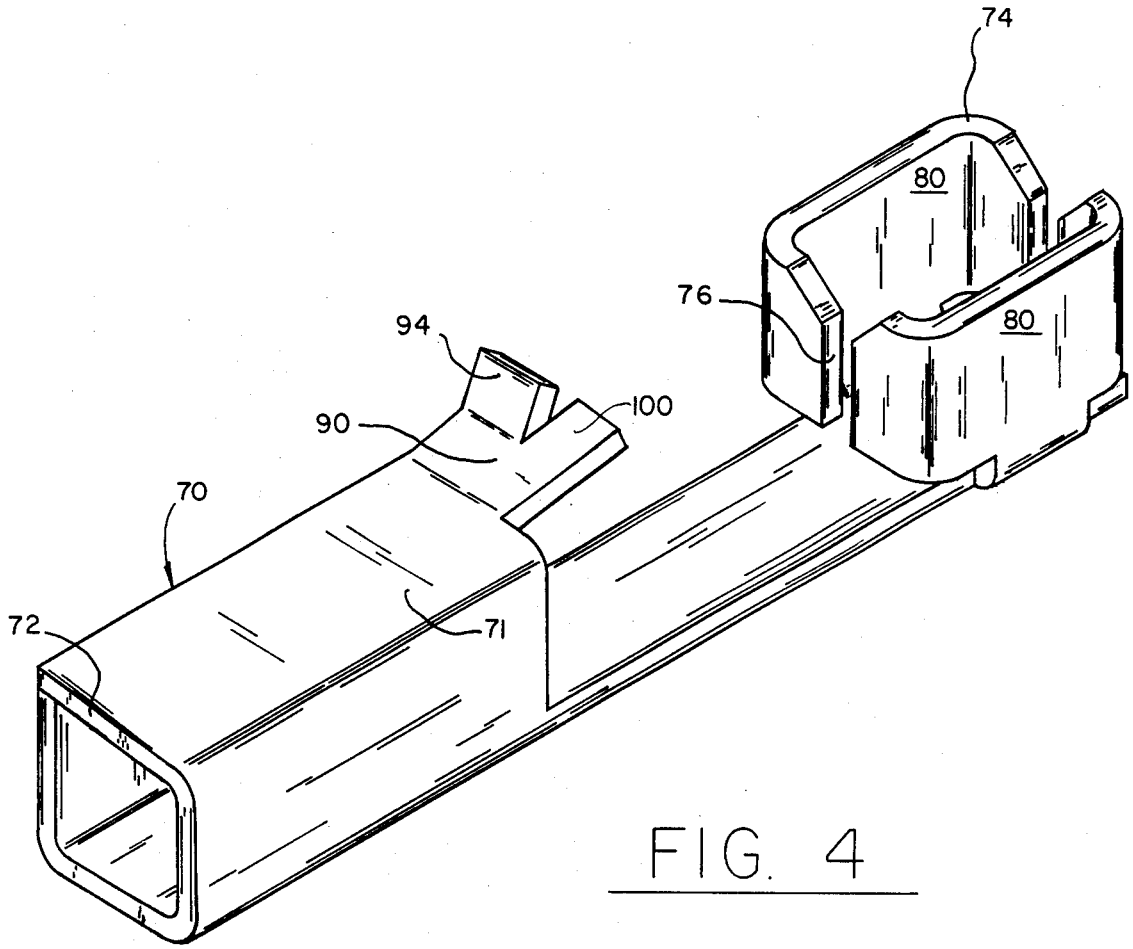
FIG. 4 is a perspective view of the terminal illustrating the lance structure.

As can be seen in FIG. 4, second lance portion 100 is conveniently formed by a fork or branch formed by bifurcating lance 90, and bending the second lance portion 100 at a shallower angle than the first lance portion 94. Thus, locking lance 90 can be conveniently and inexpensively formed utilizing, present terminal designs.

I claim:

1. An electrical terminal for mounting in a dielectric housing, said housing including a terminal receiving cavity having a longitudinally extending wall having a window formed therein with a rear edge, an interior corner formed between the longitudinally extending cavity wall and the rear window edge, said terminal including a body having a front end, a rear end and a rearwardly canted locking lance extending at a given angle from said body, said lance adapted to cooperate with said window when the terminal is fully inserted in said cavity to prevent withdrawal of said terminal from said housing cavity, the improvement in said terminal comprising:

said lance including first and second lance portions extending at different angles relative to said terminal body, whereby said interior corner is adapted to be received between said two lance portions, said first lance portion engaging said rear window edge and said second lance portion engaging said longitudinally extending cavity wall to prevent withdrawal of said terminal from said housing cavity.

2. The terminal of claim 1 wherein said window extends from an external surface of said housing to said terminal receiving cavity.

3. The terminal of claim 1 wherein the terminal is stamped from a metal blank having a thickness no greater than 0.015 inches.

4. The terminal of claim 1 wherein the housing portion immediately adjacent the window edge has a thickness no greater than 0.015 inches.

* * * * *